US008998459B2

(12) United States Patent
Chien

(10) Patent No.: US 8,998,459 B2
(45) Date of Patent: Apr. 7, 2015

(54) ILLUMINATING APPARATUS

(71) Applicant: Yu-Chen Chien, Nantou County (TW)
(72) Inventor: Yu-Chen Chien, Nantou County (TW)

( * ) Notice: Subject to any disclaimer, the term of this patent is extended or adjusted under 35 U.S.C. 154(b) by 305 days.

(21) Appl. No.: 13/747,582

(22) Filed: Jan. 23, 2013

(65) Prior Publication Data

US 2014/0204582 A1 Jul. 24, 2014

(51) Int. Cl.
*F21V 29/00* (2006.01)
*F21K 99/00* (2010.01)

(52) U.S. Cl.
CPC ..... *F21V 29/30* (2013.01); *F21V 29/004* (2013.01); *F21V 29/248* (2013.01); *F21K 9/135* (2013.01)

(58) Field of Classification Search
CPC ..... F21V 29/30; F21V 29/24; F21V 29/26; F21V 29/004; F21V 29/00; F21V 29/248; F21V 29/006; F21V 29/002; F21K 9/135
USPC ..... 362/311.02, 373, 294, 249.02, 311.04, 362/267
See application file for complete search history.

(56) References Cited

U.S. PATENT DOCUMENTS

| | | | | |
|---|---|---|---|---|
| 5,890,794 | A * | 4/1999 | Abtahi et al. | 362/294 |
| 8,847,472 | B1 * | 9/2014 | Titzler et al. | 313/22 |
| 2011/0074296 | A1 * | 3/2011 | Shen et al. | 315/112 |
| 2013/0250585 | A1 * | 9/2013 | Le Toquin et al. | 362/373 |
| 2014/0070702 | A1 * | 3/2014 | Hsin | 315/113 |

* cited by examiner

*Primary Examiner* — David V Bruce
*Assistant Examiner* — Kenny C Sokolowski
(74) *Attorney, Agent, or Firm* — Ming Chow; Sinorica, LLC

(57) ABSTRACT

An illuminating apparatus includes a lamp member, a lighting member, a waterproof member, and cooling liquid. The lamp member has a closed chamber, in which the cooling liquid is filled. The lamp member has at least a metal heat sink in the chamber, and the heat sink has at least a slot. The lighting member is isolated from the cooling liquid by the waterproof member. Therefore, the heat of the light emitting diode may be dissipated quickly through the cooling liquid.

14 Claims, 7 Drawing Sheets

ILLUMINATING APPARATUS

BACKGROUND OF THE INVENTION

1. Field of the Invention

The present invention relates generally to lighting device's structure, and more particularly to an illuminating apparatus which has a good thermal dissipation performance.

2. Description of the Related Art

Light emitting diode (LED) is widely used in the present days because of its small size, low power consumption, high efficiency, and long lifespan. FIG. 1 shows a conventional LED bulb 1, which includes a base 2, a metal core printed circuit board (MCPCB) 3 mounted on the base 2, a plurality of LEDs 4 on the MCPCB 3, and a cover 5 connected to the base 2 to cover and protect the LEDs 4. The conventional light bulbs are gradually replaced by the LED bulbs. However, the conventional LED bulb 1 still has the following drawbacks:

1. The size of the MCPCB 3 is limited by the cover 5, and therefore the LEDs 4 on the MCPCB 3 are very crowded, so that the conventional LED bulb 1 is very hot, and the heat is hard to dissipate. It will reduce the illumination efficiency and shorten the LED bulb's 1 life. The problem is even worse for a high lumens LED bulb.

2. Although the base 2 is made of aluminum, which is good at thermal dissipation, but the base 2 only has a very small area in touch with the MCPCB 3 and a dissipating surface 2*a* is far away from the MCPCB 3, so that the conventional LED bulb 1 only has poor thermal dissipation performance. Besides, the aluminum base 2 is very expensive.

3. The base 2 is opaque, and therefore the light of the LEDs 4 only comes out through the transparent cover 5. It limits the angle of illumination.

SUMMARY OF THE INVENTION

The primary objective of the present invention is to provide an illuminating apparatus which has a good thermal dissipation performance.

The secondary objective of the present invention is to provide an illuminating apparatus which has a wide angle of illumination.

According to the objective of the present invention, the present invention provides an illuminating apparatus which includes a lamp member, a lighting member, a waterproof member, and cooling liquid. The lamp member has a closed chamber, in which the cooling liquid is filled. The lamp member has at least a metal heat sink in the chamber. The heat sink has at least a slot. The lighting member is received in the slot of the heat sink, and it has at least a substrate in touch with the heat sink and at least a light emitting diode on the substrate. The substrate has a conductor pattern on a side to which the light emitting diode is electrically connected. The waterproof member is received in the slot of the heat sink to embed the conductor pattern on the substrate therein. Insulation glue is filled in the slot and solidified to form the waterproof member.

With the thermal convection of the cooling liquid, it may dissipate the heat of the light emitting diode quickly to extend the product's life.

DETAILED DESCRIPTION OF THE INVENTION

The detailed description and technical contents of the present invention will be explained with reference to the accompanying drawings. However, the drawings are illustrative only but not used to limit the present invention.

Figure 1:
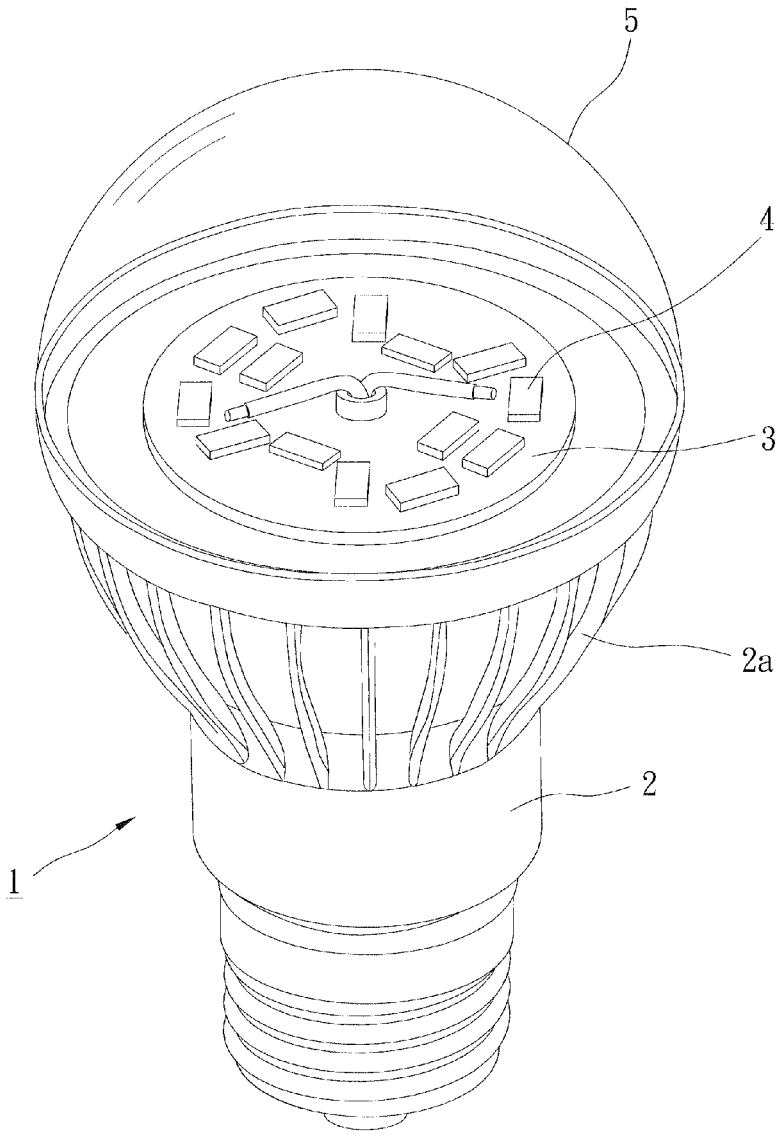
FIG. 1 (PRIOR ART)
FIG. 1 is a perspective view of the conventional LED bulb.
Figure 2:
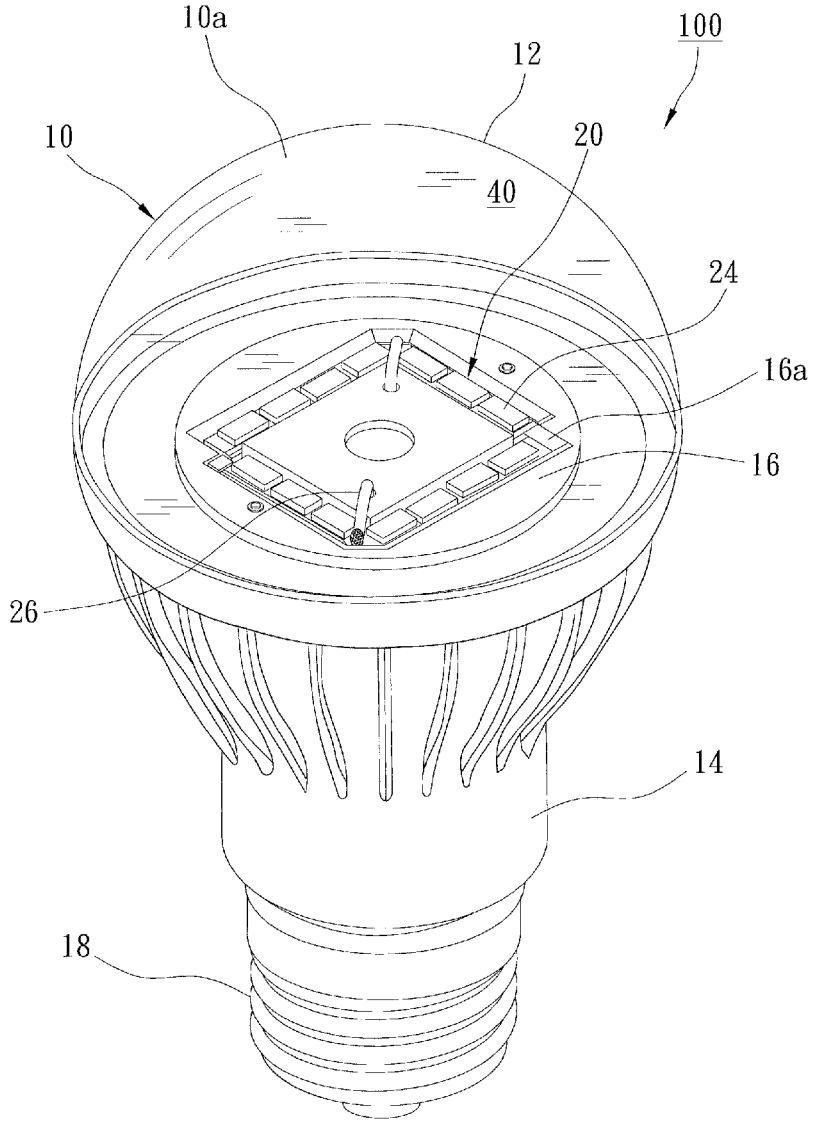
FIG. 2 is a perspective view of a first preferred embodiment of the present invention.

As shown in FIG. 2, an illuminating apparatus 100 has a lamp member 10, a lighting member 20, a waterproof member 30 and cooling liquid 40.

Figure 3:
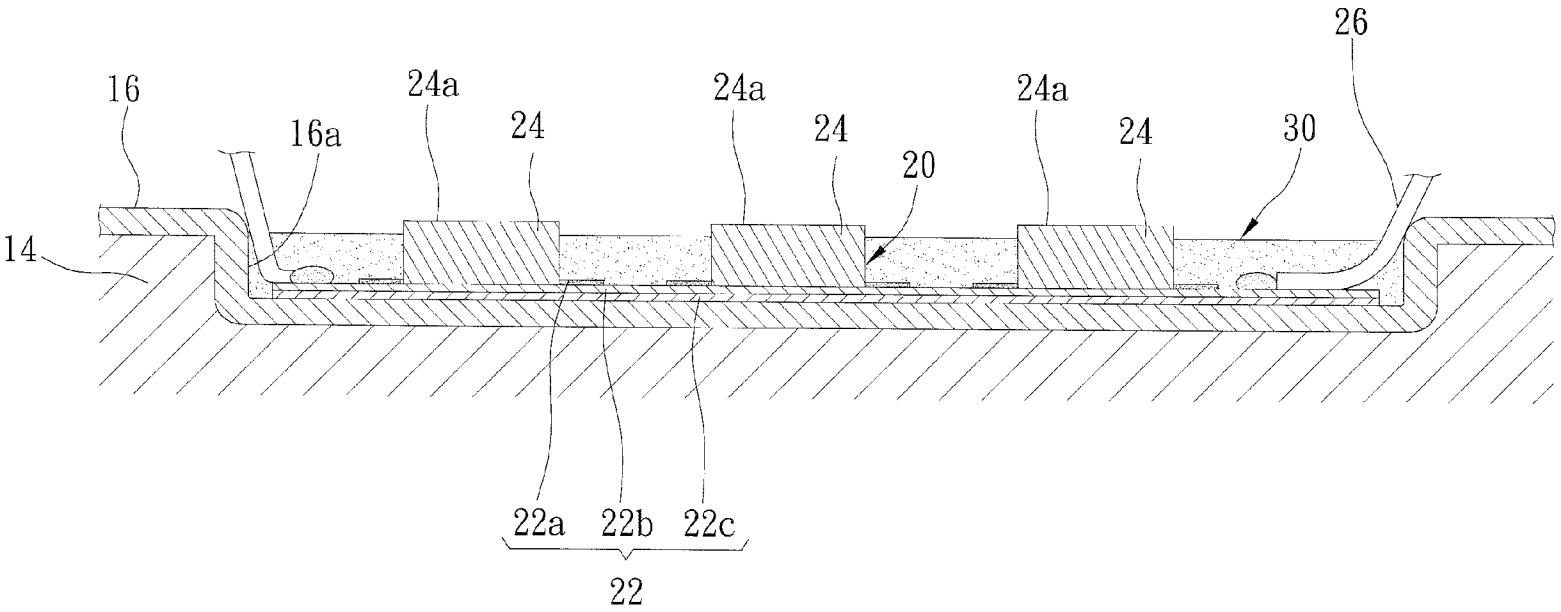
FIG. 3 is a sectional view of the first preferred embodiment of the present invention, showing the structure of the illuminating apparatus shown in FIG. 2.

The lamp member 10 has a cover 12, an insulating base 14, a metallic heat sink 16, and a conductive connector 18. The cover 12 is a transparent half-sphere plastic (such as acrylic) housing. The cover 12 is fixed to the base 14 to form a closed chamber 10*a* in the lamp member 10. The heat sink 16 is fixed to a top of the base 14. As shown in FIG. 3, the heat sink 16 is bent to form a slot 16*a*. The conductive connector 18 is connected to a bottom of the base 14 for connecting to a power supply (not shown).

The lighting member 20 is received in the slot 16*a* of the heat sink 16. The lighting member 20 has a substrate 22 and a plurality of LEDs 24.

In an embodiment, the substrate 22 is a MCPCB which has a conductor pattern 22*a*, an insulating plate 22*b* and a dissipating plate 22*c*. The conductor pattern 22*a* and the dissipating plate 22*c* are provided on opposite sides of the insulating plate 22*b*, and the dissipating plate 22*c* is attached to a bottom of the slot 16*a* of the heat sink 16 by soldering or thermal conductive adhesive. In order to obtain a good thermal dissipation performance, the dissipating plate 22*c* may be made of aluminum, copper, or other material which has a high heat transfer coefficient.

The LEDs 24 are electrically connected to the conductor pattern 22*a* of the substrate 22. The conductor pattern 22*a* is connected to an internal circuit (not shown) through waterproof wires 26, and the internal circuit is connected to the conductive connector 18 to supply the LEDs 24 with power. Each LED 24 has a light output face 24*a*.

The waterproof member 30 is formed by solidified insulation glue which is filled into the slot 16*a*. The waterproof member 30 embeds the entire conductor pattern 22*a* and other conductive portions, such as the connecting portions of the wires 26 and the conductor pattern 22*a*, therein.

In an embodiment, the cooling liquid 40 is deionized (DI) water, such as purified water, to be filled in the chamber 10*a* of the lamp member 10. The lighting member 20 is isolated from the cooling liquid 40 by the waterproof member 30, and therefore the LEDs 24 can work normally.

Because of the protection of the waterproof member 30, the cooling liquid 40 may serve the function of thermal dissipation without damaging the lighting member 20. Except the cooling liquid 40, the heat of the LEDs 24 is also transferred to the heat sink 16, which has a large area in touch with the lighting member 20. With the thermal conduction of the heat sink 16 and the thermal convection of the cooling liquid 40, the heat may be transferred out of the apparatus 1 quickly. Furthermore, the plastic cover 12 has a high thermal radiation coefficient than metallic cover, so that it may dissipate the heat out of the apparatus 1 even more quickly. The design of the present invention is preferred to be applied in a high efficiency illuminating apparatus 100 which has a plurality of LEDs 24 in series-parallel connection, as shown in FIG. 2.

The slot 16*a* of the heat sink 16 may receive the insulation glue therein to ensure covering all the conductive portions of the lighting member 20, including the conductor pattern 22*a*. Besides, the plastic cover may be mixed with metal particles according to the specific requirement. In the present invention, the heat sink 16 and the cooling liquid 40 are the two elements which serve the function of thermal dissipation so that the base 14 may be made of plastic to reduce the cost.

Figure 4:
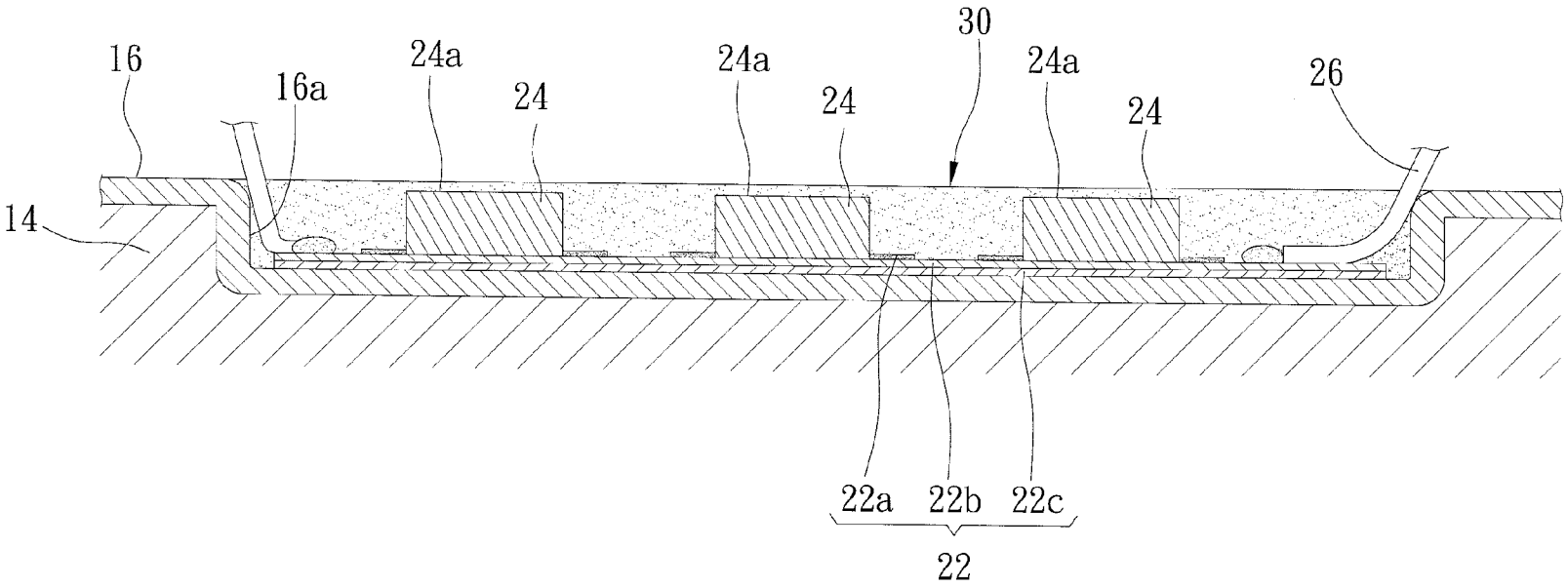
FIG. 4 is a sectional view of the first preferred embodiment of the present invention, showing the waterproof member embedding the output faces of the LEDs therein.

In an embodiment, the light output faces 24*a* of the LEDs 24 are uncovered by the waterproof member 30. In another embodiment, the light output faces 24*a* of the LEDs 24 are embedded in the waterproof member 30 therein (FIG. 4). It may protect the LEDs 24 by the waterproof member 30, so that the LEDs 24 may be not damaged by the cooling liquid 40.

Figure 5:
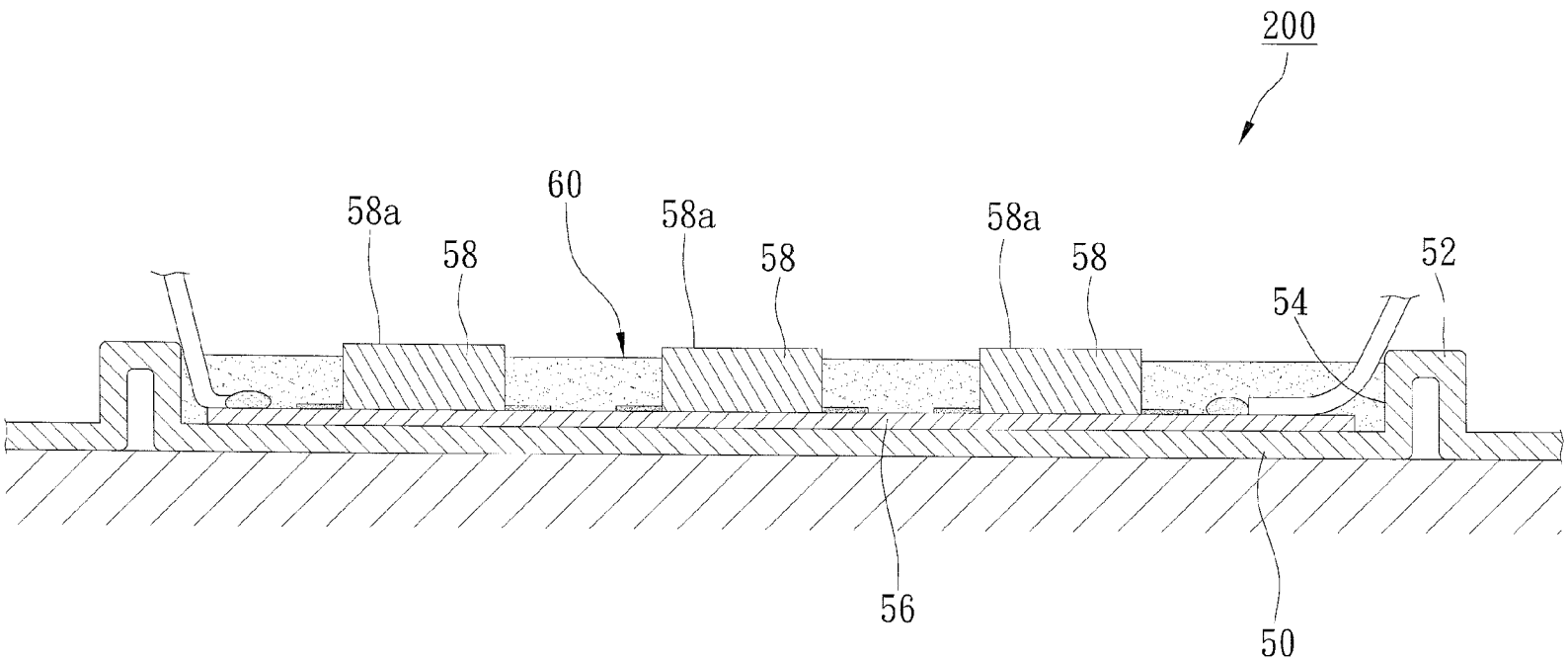
FIG. 5 is a sectional view of a second preferred embodiment of the present invention, showing the slot and the dissipating member.

FIG. 5 shows an illuminating apparatus 200 of the second preferred embodiment of the present invention, which is similar to the illuminating apparatus 100, except that a metallic heat sink 50 has an annular wall 52 vertically projected from a top thereof, and therefore slots 54 are formed within the wall 52. The slot 54 is received with a substrate 56 and a plurality of LEDs 58 on the substrate 56, and is filled with a waterproof member 60. The slot 54 serves the same function for containing the insulation glue as described above. FIG. 5 shows that light output faces of the LEDs 58 are uncovered by the waterproof member 60. However, the waterproof member 60 may embed the light output faces of the LEDs 58 therein as described above.

In an embodiment, the walls 52 are made of metal, and they are inherently formed with the heat sink 50. In another embodiment, the walls 52 are made of plastic attached to the heat sink 50 by any known way. The plastic walls 52 may reduce the cost.

Figure 6:
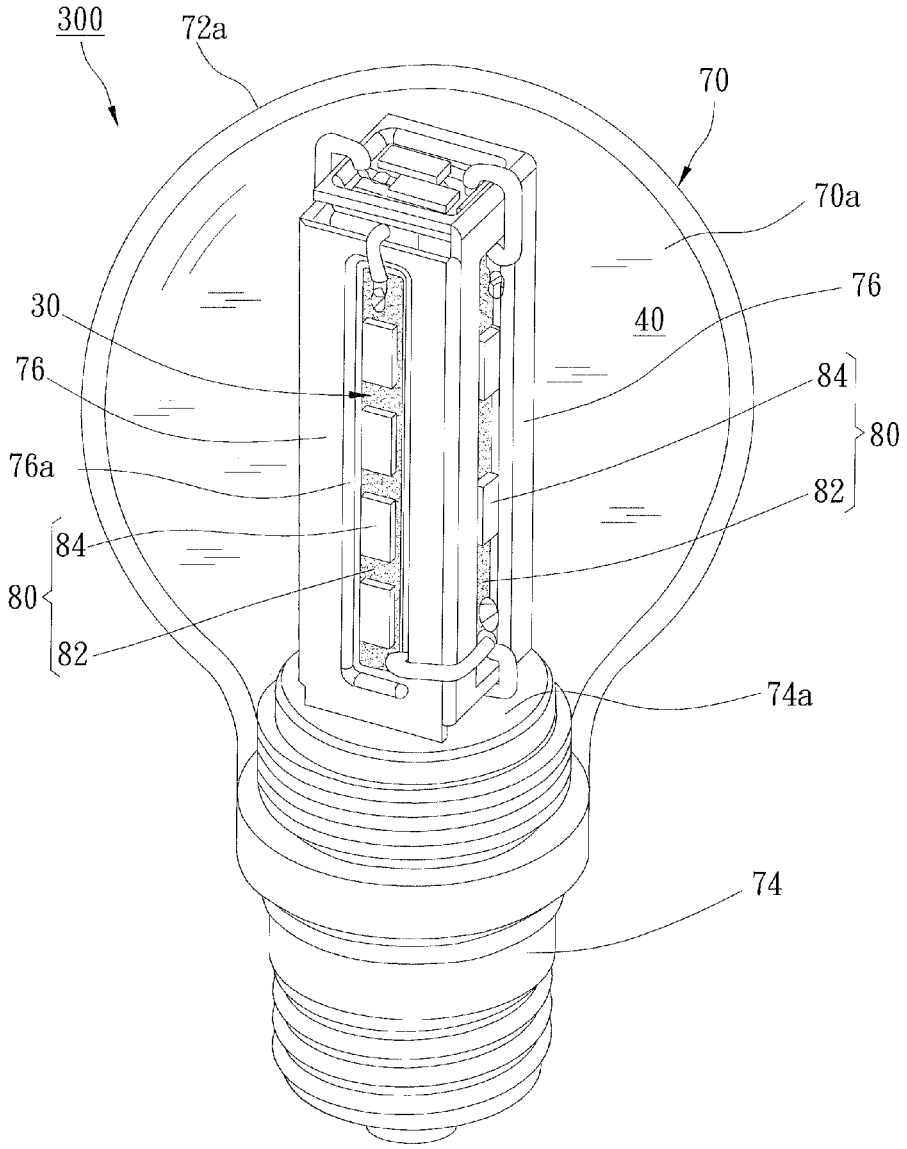
FIG. 6 is a perspective view of a third preferred embodiment of the present invention.
Figure 7:
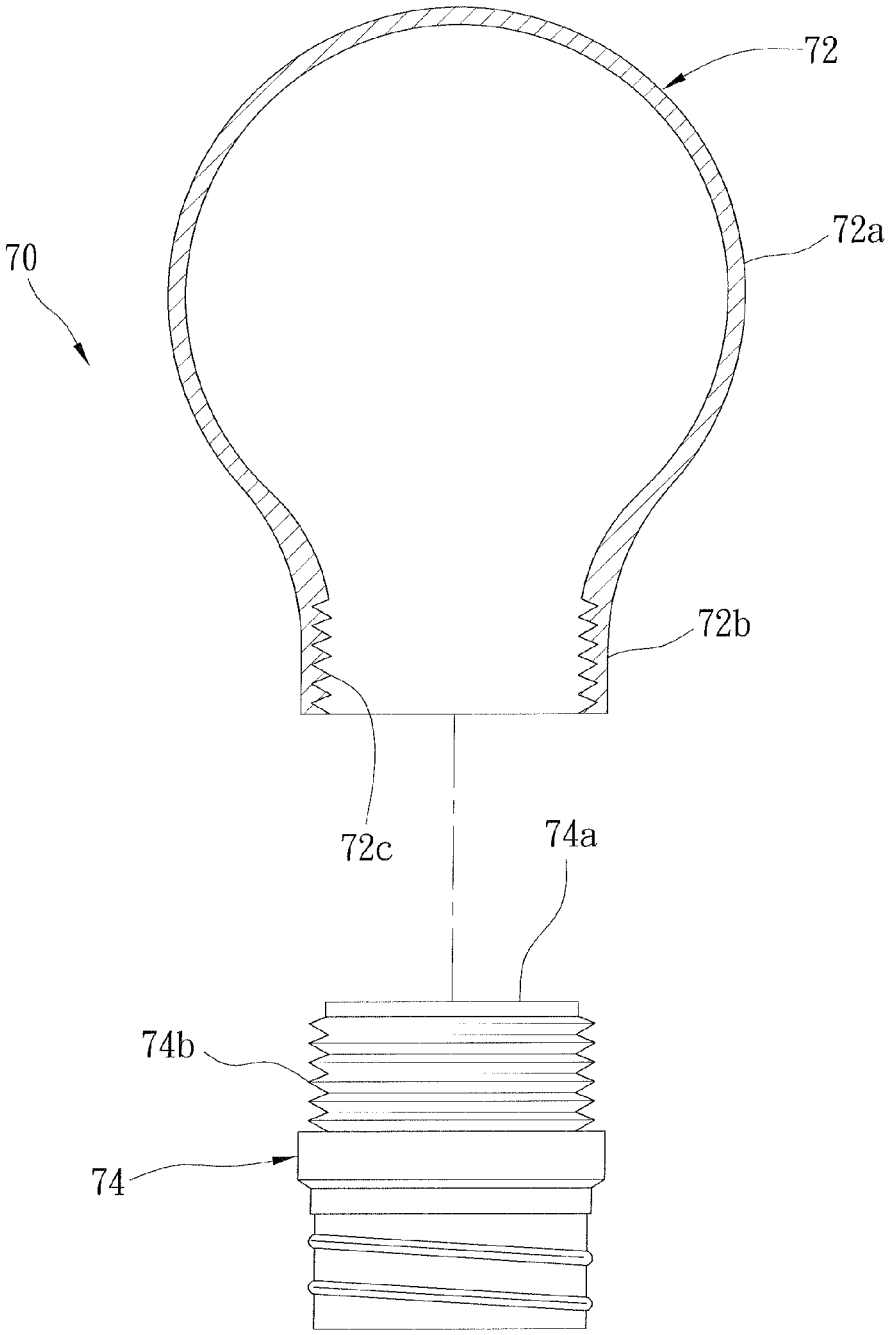
FIG. 7 is a sectional view of the third preferred embodiment of the present invention.

As shown in FIG. 6 and FIG. 7, an illuminating apparatus 300 of the third preferred embodiment, the same as above, provides the cooling liquid 40 for thermal dissipation and waterproof member 30 for isolation. The different parts are:

The illuminating apparatus 300 has a lamp member 70, which includes a cover 72 and an insulating base 74. The cover 72*a* has a ball housing 72*a* and a tube 72*b* at an end of the ball housing 72*a*. The tube 72*b* is provided with a threaded section 72*c* at an inner side thereof. The insulating base 74 has a mounting portion 74*a* and a threaded connector 74*b*. The threaded connector 74*b* is meshed with the threaded section 72*c* of the cover 72 to form a chamber 70*a* in the lamp member 70, in which the cooling liquid 40 is filled. Four heat sinks 76 are vertically mounted on the mounting portion 74*a* of the insulating base 74 to form a rectangular pillar. Therefore, the heat sinks 76 are received in the ball housing 72*a* and are closer to its inner side than the first preferred embodiment. Each heat sink 76 is provided with an elongated slot 76*a*.

A lighting member 80 has a plurality of substrates 82 and a plurality of LEDs 84 on each substrate 82. The substrates 82, which are MCPCB in the embodiment, are respectively received in the slots 76*a* of the heat sinks 76. The function of the substrates 82 and the LEDs 84 are the same as described above, so we do not describe the detail again. Because that the heat sinks 76 are arranged in an annular pattern and the LEDs 84 are lined in a vertical direction, the LEDs 84 may emit light in all directions out of the ball housing 72*a*. Therefore, illuminating apparatus 300 has a good thermal dissipation and a wide angle of illumination.

The substrate of the light member is required to have a good electrical insulation and a high heat transfer coefficient, so that the substrate may be, except for the MCPCB as described above, thick film ceramic substrate, and direct bonded copper (DBC) substrate is more preferable. Of course, the thick film ceramic substrate has the same elements, such as the conductor pattern, as described above.

The illuminating apparatus of the present invention may be incorporated in street lamp, recessed lamp, projection lamp, headlamp, flashlight, and other equivalent devices.

The description above is a few preferred embodiments of the present invention, and the equivalence of the present invention is still in the scope of claim construction of the present invention.

What is claimed is:

1. An illuminating apparatus, comprising:

a lamp member having a closed chamber therein and at least a metal heat sink in the chamber, wherein the heat sink has at least a slot;

a lighting member, which is received in the slot of the heat sink, having at least a substrate in touch with the heat sink and at least a light emitting diode on the substrate, wherein the substrate has a conductor pattern on a side to which the light emitting diode is electrically connected;

a waterproof member received in the slot of the heat sink to embed the conductor pattern of the substrate of the lighting member therein, wherein an insulation glue is filled in the slot and solidified to form the waterproof member; and cooling liquid received in the chamber of the lamp member.

2. The illuminating apparatus as defined in claim 1, wherein the lamp member includes an insulating base and a cover connected to the base to form the chamber in the cover; and the heat sink is provided on the base.

3. The illuminating apparatus as defined in claim 2, wherein the heat sink is bent to form the slot.

4. The illuminating apparatus as defined in claim 2, wherein the heat sink has an annular wall to form the slot therewithin.

5. The illuminating apparatus as defined in claim 4, wherein the wall is inherently formed on the heat sink.

6. The illuminating apparatus as defined in claim 4, wherein the wall is made of plastic.

7. The illuminating apparatus as defined in claim 2, wherein the cover has a ball housing and a tube connected to the ball housing; and the tube has a threaded section at an inner side thereof to engage a threaded connector of the base.

8. The illuminating apparatus as defined in claim 7, wherein there are a plurality of the heat sinks, the substrates and the light emitting diodes; the heat sinks are arranged in different orientations; tops of the substrates are close to the ball housing; each of the slots of the heat sinks are received with one of the substrates respectively; and each of the substrates has a plurality of the light emitting diodes.

9. The illuminating apparatus as defined in claim 2, wherein the cover is made of plastic.

10. The illuminating apparatus as defined in claim 2, wherein the cover is made of plastic mixed with metallic particles.

11. The illuminating apparatus as defined in claim 2, wherein the base is made of plastic.

12. The illuminating apparatus as defined in claim 1, wherein the substrate of the lighting member includes an insulating plate and a dissipating plate; the conductor pattern and the dissipating plate are respectively provided on opposite sides of the insulating plate; and the dissipating plate touches a bottom of the slot of the heat sink.

13. The illuminating apparatus as defined in claim 1, wherein the substrate of the lighting member is a thick film ceramic substrate.

14. The illuminating apparatus as defined in claim 1, wherein the light emitting diode has a light output face, and the light output face is embedded in the waterproof member.

* * * * *